US008289124B2

(12) United States Patent
Hofsaess

(10) Patent No.: US 8,289,124 B2
(45) Date of Patent: Oct. 16, 2012

(54) TEMPERATURE-DEPENDENT SWITCH

(76) Inventor: Marcel P. Hofsaess, Pforzheim (DE)

( * ) Notice: Subject to any disclaimer, the term of this patent is extended or adjusted under 35 U.S.C. 154(b) by 285 days.

(21) Appl. No.: 12/556,843

(22) Filed: Sep. 10, 2009

(65) Prior Publication Data

US 2010/0066478 A1 Mar. 18, 2010

(30) Foreign Application Priority Data

Sep. 16, 2008 (DE) ..... 10 2008 048 554

(51) Int. Cl.
*H01H 37/04* (2006.01)
*H01H 37/52* (2006.01)

(52) U.S. Cl. ..... 337/372; 337/333; 337/362; 337/380

(58) Field of Classification Search ..... 337/372, 337/333, 380, 362
See application file for complete search history.

(56) References Cited

U.S. PATENT DOCUMENTS 3,430,177 A * 2/1969 Audette ..... 337/365
3,443,259 A * 5/1969 Wehl et al. ..... 337/89
4,149,138 A * 4/1979 Pevzner et al. ..... 337/372
4,414,529 A * 11/1983 Yoshioka et al. ..... 337/36
4,539,545 A * 9/1985 Klotz ..... 337/380
4,620,175 A * 10/1986 Karr et al. ..... 337/343
4,849,729 A 7/1989 Hofäss
4,862,133 A * 8/1989 Tabei ..... 337/102
5,233,325 A * 8/1993 Takeda ..... 337/107
5,268,664 A * 12/1993 Givler ..... 337/380
5,337,036 A 8/1994 Kuczynski
5,621,376 A * 4/1997 Takeda ..... 337/372
5,659,285 A * 8/1997 Takeda ..... 337/389
5,757,261 A 5/1998 Becher et al.
5,757,262 A * 5/1998 Takeda ..... 337/380
5,847,637 A * 12/1998 Takeda et al. ..... 337/344
5,864,278 A 1/1999 Becher
5,939,970 A * 8/1999 Tsuji et al. ..... 337/343
6,020,807 A * 2/2000 Givler ..... 337/377
6,064,295 A 5/2000 Becher et al.
6,100,784 A 8/2000 Hofsäss
(Continued)

FOREIGN PATENT DOCUMENTS

AT 307 770 6/1973
(Continued)

*Primary Examiner* — Anatoly Vortman
(74) *Attorney, Agent, or Firm* — Harness, Dickey & Pierce, P.L.C.

(57) ABSTRACT

A temperature-dependent switch (10) has a housing (11), on which a first and a second external connection (17, 18) are arranged, and a temperature-dependent switching mechanism (33, 29) , which is arranged in the housing (11) and makes an electrically conductive connection between the first and the second external connection (17, 18) as a function of its temperature, wherein the switching mechanism (33, 29) has a spring part (33), which is electrically connected at its first end (37) to an external connection (17) and is fitted at its second end (36) with a moving contact part (32) which interacts with the second external connection (18), and a bimetallic part (29) which electrically disconnects the moving contact part (32) from the second external connection (18) as a function of its temperature. The housing (11) is closed on its upper side by an electrically conductive cover part (12) which is directly connected to the first external connection (17). The spring part (33) is firmly connected at its first end (37) to the cover part (12) in a captive manner so that the parts can be placed as a unit during the assembly process.

17 Claims, 6 Drawing Sheets

U.S. PATENT DOCUMENTS

| | | | | |
|---|---|---|---|---|
| 6,191,680 | B1 | 2/2001 | Hofsäss | |
| 6,281,780 | B1 * | 8/2001 | Sugiyama et al. | 337/137 |
| 6,396,381 | B1 * | 5/2002 | Takeda | 337/377 |
| 6,515,571 | B2 * | 2/2003 | Takeda | 337/375 |
| 6,633,222 | B2 * | 10/2003 | Nagai et al. | 337/365 |
| 6,756,876 | B2 * | 6/2004 | Sullivan et al. | 337/111 |
| 6,801,116 | B2 * | 10/2004 | Oh et al. | 337/112 |
| 6,995,647 | B2 * | 2/2006 | Stiekel | 337/112 |
| 7,026,907 | B2 * | 4/2006 | Takeda | 337/85 |
| 7,075,403 | B2 * | 7/2006 | Unno et al. | 337/365 |
| 7,292,131 | B2 * | 11/2007 | Masuda | 337/365 |
| 2001/0050609 | A1 | 12/2001 | Takeda | |
| 2003/0122650 | A1 | 7/2003 | Yamamoto et al. | |

FOREIGN PATENT DOCUMENTS

| | | | |
|---|---|---|---|
| DE | 21 06 132 | | 10/1971 |
| DE | 26 44 411 | | 4/1978 |
| DE | 37 10 672 | C2 | 10/1988 |
| DE | 196 09 310 | A1 | 9/1997 |
| DE | 197 08 436 | A1 | 9/1998 |
| DE | 101 19 467 | A1 | 10/2001 |
| EP | 0 756 302 | A2 | 1/1997 |
| EP | 0 858 090 | A2 | 8/1998 |
| JP | 2004 220944 | | 8/2004 |

* cited by examiner

TEMPERATURE-DEPENDENT SWITCH

FIELD OF THE INVENTION

The present invention relates to a temperature-dependent switch having a housing, on which housing a first and a second external connection are provided, and having a temperature-dependent switching mechanism, which switching mechanism is arranged in the housing and makes an electrically conductive connection between the first and the second external connection as a function of its temperature, wherein the switching mechanism comprises a spring part, which is electrically connected at its first end to an external connection and at its second end carries a moving contact part which interacts with the second external connection, and a bimetallic part, which electrically disconnects the moving contact part from the second external connection as a function of its temperature.

BACKGROUND OF THE INVENTION

A switch of this kind is known from EP 0 858 090 A2.

The known switch comprises a two-part housing made from insulating material, into which housing a temperature-dependent switching mechanism is inserted. The switching mechanism comprises a spring part with a spring disc as a free end, which spring disk carries approximately centrally a moving contact part, on which moving contact part a bimetallic snap-action disc is also arranged. As fixed end of the spring part a holding attachment is provided laterally at the spring disc and is mounted by means of a pin on a bottom electrode, which is provided on the lower part of the housing.

The moving contact part interacts with a fixed opposing contact which is provided internally on the cover part of the housing, as a cover electrode. The bottom electrode and the cover electrode each have an external connection, into which the stripped end of the connecting wire is inserted.

Via its rim area, the spring disc rests on an inner, projecting shoulder, which shoulder is provided internally on the housing lower part; the rim area not being equipped with said holding attachment.

Depending on the temperature of the bimetallic snap-action disc, the moving contact part rests on the fixed opposing contact, thus resulting in an electrically conductive connection being made between the two external connections via the fixed opposing contact, the moving contact part, the spring disc and the holding attachment.

When the temperature of the bimetallic snap-action disc rises above the response temperature thereof, then it switches over from its convex shape to a concave shape, in which its rim is supported on shoulders and stops which are provided for this purpose in the upper housing part, thereby lifting the moving contact part off the fixed opposing contact, against the force of the spring disc. To do this, it is necessary for the bimetallic snap-action disc to push the spring disc through, as a result of which the spring disk also changes from its convex shape to the concave shape.

In the known switch, the temperature-dependent switching mechanism is a captive unit comprising the spring part, which is formed by the spring disc and the holding attachment, the bimetallic snap-action disc and the moving contact part.

AT 307 770 B discloses a temperature-dependent switch in which a housing lower part which is in the form of a pot and is composed of metal is closed by a cover composed of insulating material. A bimetallic switching mechanism comprising a bimetallic snap-action disc and a spring part is arranged in the housing that is formed in this way, which bimetallic switching mechanism has a circular frame and a spring tongue which extends inwards from this frame and at whose free end a moving contact part is arranged. The moving contact part interacts with a fixed opposing contact, which is arranged centrally on the cover part. The bimetallic snap-action disc is firmly connected to the spring tongue and lifts the moving contact part off the fixed opposing contact, with which it is otherwise in contact, when the response temperature is exceeded.

DE 101 19 467 A1 discloses a temperature-dependent switch having a plastic carrier forming an accommodation area for a switching mechanism comprised of a spring and a bimetallic tongue. At the upper and lower sides of the carrier, the accommodation area is closed off by each a metal plate, an external connection being provided at each metal plate.

At its first end, the spring is clamped to the plastic carrier, whereby the bimetallic tongue is clamped to the spring.

At one of the metal plates closing off the accommodation area a fixed counter contact is provided, which counter contact cooperates with a moveable contact provided at the front free end of the spring. Thus, when the known switch is closed, the current to be switched flows through the spring.

When assembling the known switch, many parts have to be put together. Only when completely assembled, the spring of the known switch is in firm contact with one of the metal plates.

The temperature-dependent switch and switching mechanisms which have been described so far are used to protect an electrical appliance against an excessively high temperature. For this purpose, the supply current for the appliance to be protected is passed through the temperature-dependent switch and the temperature-dependent switching mechanism, respectively, with the switch and the switching mechanism, respectively, being thermally coupled to the appliance to be protected. At a response temperature, which is predetermined by the snap-over temperature of the bimetallic snap-action disc, the respective switching mechanism then opens the circuit, by lifting the moving contact part off the fixed opposing contact.

All of the switching mechanisms described so far have the advantage that the current to be disconnected does not flow directly via the bimetallic snap-action disc but is passed via the spring part. This reduces the intrinsic heating of the bimetallic snap-action disc, although heat is still created in the interior of the switches as a result of the intrinsic heating of the spring part, as a result of which this intrinsic heating also influences the switching response, in addition to the externally supplied heat in the appliance to be protected.

While the intrinsic heating of the spring part is undesirable in the switches and switching mechanisms which have been described so far, switches are also known in which a series resistance is also provided, which series resistor is heated in a defined manner by the current flow of the appliance to be protected. If the current flow is too high, this resistance is heated to such an extent that the snap-over temperature of the bimetallic snap-action disc is reached. In addition to monitoring the temperature of the appliance, this also makes it possible to monitor the current flowing, and the switch therefore has a defined current dependency.

In order to ensure that a switch of this kind does not close again after the appliance or the series resistance has cooled down, it is also known for a further resistance, preferably a PTC thermistor, to be provided in parallel with the temperature-dependent switching mechanism, which further resistance is electrically short-circuited by this temperature-dependent switching mechanism when the latter is closed. However, when the switching mechanism opens, the parallel resistance carries a portion of the previously flowing current and in the process is heated to such an extent that it produces a sufficient amount of heat in order to maintain the bimetallic snap-action disc at a temperature which is above the response temperature. This process is referred to as self-holding and prevents a temperature-dependent switch from closing again in an uncontrolled manner when the appliance to be protected has cooled down again as a result of the current being disconnected.

In the case of the switches and switching mechanisms described so far, the series resistance and the parallel resistance must be provided separately, which is associated with corresponding complexity.

However, on the other hand, these designs are also subject to the disadvantage that they are complicated and are formed from a large number of components, with a high level of production precision being required, in particular because of the round spring discs, because the round discs require a high-precision contact surface on the respective rim. For this reason, the housings are frequently manufactured as turned part, in order to ensure high-precision contact surfaces. The small contact surfaces between the spring discs and the contact rims in this case lead, however, to undesirably high contact resistances, with the spring parts themselves frequently being undesirably heated to a major extent, as a result of which a certain current dependency is present.

A further disadvantage of these switches is that they can switch only low current levels. Higher currents would lead to the formation of arcs and to the generation of sparks on opening of the switch, which leads to undesirable contact erosion and, if the contact separation is too small in the open state, even to the arc not being quenched or not being quenched quickly, as a result of which an undesirably high residual current can still flow. Furthermore, in this case, there is a risk of the flying sparks damaging the bimetallic snap-action disc or leading to rapid ageing of the bimetallic snap-action disc, both of which may result in an undesirable shift in the switching point.

In addition, the connection between the spring part and the first external connection does not allow high currents, because the riveting or clamped connection which is possible by virtue of the design, between the external connection and the fixed end of the spring part, leads to connections which are not still safe at high currents as well, because of the remaining contact resistance. In fact, flashovers occur to areas of the connected metal parts which are not in close contact or tightly fitting over the entire area, thus leading to contact erosion and, in consequence, to further deteriorating contact resistances during the course of operation.

In order to switch relatively high currents up to, for example, 10 amperes, temperature-dependent switches with a contact bridge are therefore used, as are described in DE 26 44 411 A1 and DE 197 08 436 A1. These switches have two fixed opposing contacts and two moving contact parts, which are connected to one another via a contact bridge. The bimetallic snap-action disc is arranged on the side of the contact bridge facing away from the fixed opposing contacts, and is therefore protected against possible sparking.

However, these switches have a complicated design and are difficult to assemble. A further disadvantage is that two pairs of switching contacts comprising a contact part and an opposing contact are required. Since these contact parts and opposing contact parts must be very massy because of the high switching currents and can be manufactured only as expensive turned parts, the known switches are very costly also for this reason. Furthermore, during assembly, care must be taken to ensure that the two moving contact parts are located precisely opposite the fixed opposing contacts. This also leads to stringent requirements both with regard to dimensional accuracy of the various individual parts, and with regard to the assembly quality itself.

SUMMARY OF THE INVENTION

In view of the above, it is an object of the present invention to improve the temperature-dependent switch mentioned at the outset such that it can reliably switch high current levels, while having a physically simple design.

According to the invention, this and other objects are achieved with the temperature-dependent switch mentioned at the outset by means of an electrically conductive cover part which closes off the housing on its upper side and is directly connected to the first external connection, wherein the spring part is firmly connected in a captive manner at its first end to the cover part.

The object underlying the invention is completely achieved in this way.

Because the cover part is itself electrically conductive, the spring part can be directly connected to it over a large area. This allows a good contact with a very low contact resistance, via which high currents in the region, for example, of 10 amperes can be passed. This also makes it possible to ensure that the moving contact part has a long switching distance in the housing, as a result of which any arc that may be created is quenched quickly and reliably.

Since the spring part is furthermore connected in a captive or inseparable manner to the cover part, for example by adhesive bonding, soldering or welding, the novel switch can also be assembled easily and reliably. During initial assembly, the cover part and the spring part can be reliably and firmly connected to one another, thus ensuring a low contact resistance here as well. Only after this is the cover part placed on the housing, as a result of which the spring part is introduced and positioned at the same time.

In addition, only one pair of switching contacts, comprising a moving contact part and a fixed opposing contact, are required, thus saving costs and assembly effort. The contact part and the opposing contact may be high-precision turned parts, but may also be parts that are produced in some other way.

According to one object, it is preferred if a bottom part is provided which closes the housing on its lower side and is preferably electrically conductive and directly connected to the second external connection.

In this case, it is advantageous that the novel switch is composed of only a small number of parts and can be assembled easily. Furthermore, this measure allows a long switching movement for the moving contact part, thus further improving the switching reliability for high currents.

On the other hand, it is also possible to design the housing like a pot, as a result of which it is closed on its lower side, and to insert a bottom electrode or to insert-mould this with the housing, as is described in DE 196 09 310. However, a separate bottom part offers the advantage that a fixed opposing contact can be welded on very easily before the bottom part is fitted to the housing.

According to a further object, the housing comprises a solid base block, in which base block at least one accommodation area for the temperature-dependent switching mechanism is provided, whereby the base block is closed by the bottom part, which is in the form of a first flat metal part, and by the cover part, which is in the form of a second flat metal part, and wherein the cover part and the bottom part are preferably fixed to the base block by means of flanged edges.

These measures have the design advantage that the novel switch comprises a very small number of components, which, further, can be produced and assembled easily. The flat metal parts in this case have the further advantage that they allow very good thermal linking between the switch and the appliance whose temperature development is to be monitored. Furthermore, a switch produced in this way is highly pressure-resistant. Finally, the flanged edges, by means of which the metal parts are fixed on the base block, ensure that the interior of the switch is protected against the introduction of moisture and dirt. Last, the making of the flanges is a process which can be carried out very easily, quickly and reliably, for example, by hot pressing, ultrasound or UV or IR irradiation, thus further simplifying the fabrication of the new switch.

According to a still further object, the housing is at least partially manufactured from insulation material, preferably from thermally conductive plastic or ceramic.

One advantage in this case is that, so to speak, the cover part and the bottom part are automatically isolated from one another during assembly, making it possible to dispense with additional insulating discs, such as those which are actually frequently required in the prior art for high-current switches.

According to an other object, it is preferred if the housing is at least partially manufactured from an electrically conductive material, preferably from PTC material, which is electrically connected both to the first external connection and to the second external connection.

In addition to the advantages of automatic isolation as mentioned above, this provides for a self-holding function without any need to provide an additional parallel resistance, because this is formed by the housing itself It is also an object that the spring part comprises a spring tongue which is integrally connected at its first end to an electrically conductive transverse metal sheet, which is connected to the cover part, wherein the transverse metal sheet is preferably formed integrally at an electrically conductive frame which rests flat on the cover part and is firmly connected thereto at least at points, preferably by welding, and wherein, further preferably, a circumferential shoulder is formed on the housing, on which shoulder the cover part rests with the interposition of the frame.

These measures additionally increase the already mentioned advantages. On the one hand, the contact resistance between the frame or spring tongue and the cover part is extremely low, since a large contact area is provided, with a good and firm connection. Furthermore, the spring part has a relatively large mass, as a result of which it is heated only slightly even when high switching currents occur, and this in turn leads to good switching point stability, since the intrinsic heating is negligible.

On the other hand, the number of components required is reasonably small, with the chosen design meaning that it is sufficient for the frame to be attached to the cover part just at points. There is no need for large-area welding or adhesive bonding, thus further simplifying the assembly process.

Finally, it is an object that the spring tongue carries at its second, free end the moving contact part, and if a fixed opposing contact is arranged on the bottom part.

In this case, it is advantageous that, in the case of the novel switch, the pair of switching contacts is provided by means of turned parts which can be manufactured precisely, thus allowing reliable switching of high currents.

According to a general object the bimetallic part is arranged loosely next to the moving contact part in an accommodation area within the housing, which accommodation area is open to the cover part, the bimetallic part preferably acting on an operating section of the spring tongue, which operating section is located between the first end and the second end of the spring tongue, it being furthermore preferred if the operating section of the spring tongue comprises a spherical cup which points towards the bimetallic part.

These measures on the one hand have the advantage that the bimetallic part is located outside the area of the switching contacts, that is to say it is arranged such that it is protected against possible arcs or sparking. Because the bimetallic part acts on the spherical cup, reliable switching is also possible with simpler bimetallic parts which need not be in the form of the high-precision and therefore expensive bimetallic snap-action disc. Furthermore, the spherical cup ensures that the moving contact part has a long switching movement. This all furthermore contributes to the novel switch being able to reliably switch high currents, while nevertheless being of simple design.

Finally, however, the assembly of the novel switch is also simplified because the bimetallic part need not be attached to the moving contact part or the spring part before insertion of the switching mechanism, and is simply inserted into the housing. This saves process steps which moreover would be time-consuming and complicated.

It is also preferred if a through-hole is provided in the housing, in which through hole the moving contact part is arranged, in which case, preferably, a web is provided between the accommodation area and the through-hole, which web fixes the bimetallic part at the side and screens it from the moving contact part.

This contributes to even better screening of the bimetallic part from the pair of switching contacts.

Overall, it is preferred if a through-hole, which extends from the first to the second flat metal part, is provided in the base block, into which through-hole the spring tongue with the moving contact part extends laterally, if in the through-hole a fixed opposing contact is arranged on the second metal part, and if a web is provided between the accommodation area and the through-hole.

This also contributes to better screening of the bimetallic part.

According to a further object, the novel switch consists exclusively of the base block, the first and the second metal part, the one-piece spring part which is firmly connected to the first metal part and is comprised of the frame and the spring tongue, the fixed opposing contact, the moving contact part and the bimetallic part.

In this case, it is advantageous for the novel switch to be formed from only seven components which, furthermore, can be assembled quickly, easily and reliably. After manufacturing the seven individual parts, the moving contact part is mounted on the spring tongue, and the fixed opposing contact is mounted on the bottom part. The spring part is then welded to the cover part. The lower side or face of the housing base block is now closed by the bottom part. The bimetallic part is then inserted, and the upper side of the base block is then closed with the cover part, with the spring part being inserted and positioned at the same time.

Furthermore, because of this design, the novel switch is suitable for reliable switching of even high current levels in the region of 10 amperes or more.

Overall, it is preferred if the cover part, the bottom part and the spring part in this case are one-piece stamped parts.

These measures contribute to a low-cost switch.

According to a further object, a ceramic disc is provided geometrically between the bimetallic part and the spring part.

This measure advantageously means that the bimetallic part is protected even better against sparking etc., as a result of which the switch can be used overall for switching even higher voltages, powers and currents.

Further advantages and features will become evident from the description and the attached drawing.

It is self-evident that the features mentioned above and those which are still to be explained in the following text can be used not only in the respectively stated combination but also in other combinations or on their own without departing from the scope of the present invention.

BRIEF DESCRIPTION OF THE DRAWINGS

Embodiments of the invention will be explained in more detail in the following description, and are illustrated in the drawing, in which.

DESCRIPTION OF A PREFERRED EMBODIMENT

Figure 1:
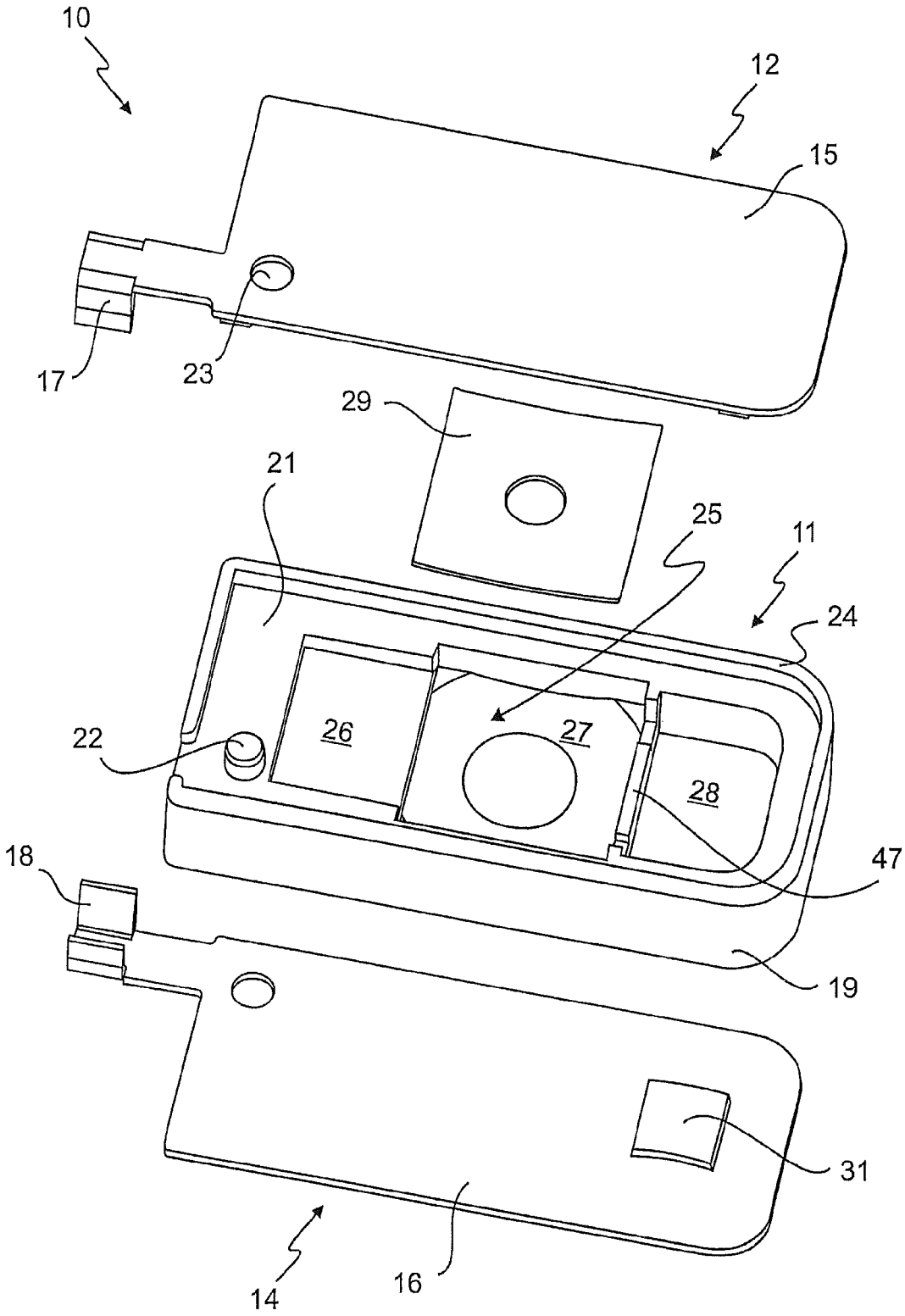
FIG. 1 shows an exploded illustration of the novel switch, in the form of a schematic view from above.

FIG. 1 shows an exploded illustration of a temperature-dependent switch 10 in the form of a schematic view from above. The switch 10 has a housing 11 composed of insulating material or PTC material, which is closed by an electrically conductive cover part 12 on its upper side and by an electrically conductive bottom part 14 on its lower side.

The cover part 12 and the bottom part 14 are stamped out as flat metal parts 15 and 16, respectively, and are integrally connected to a first and second external connection 17 or 18, respectively.

The external connections 17 and 18 are in the form of clamping parts which have a U-shaped cross section. Stripped ends of connecting wires are to be inserted into these clamping parts and to be firmly connected by bending around the sidewalls of external connections 17 and 18.

Housing 11 comprises a solid base block 19 with an upper circumferential shoulder 21, on which cover part 12 rests. A pin 22 is formed on shoulder 21, and a through-hole 23 in cover part 12 is positioned on this pin 22.

Shoulder 21 is bounded by a circumferential edge 24 which has a cutout in the area of pin 22, in which cutout external connection 17 is located. Once cover part 12 has been fitted, the edge is flanged-over in some suitable manner in order to firmly mount the cover part 12 on the base block 19 thus sealing the interior of the switch 10 at the same time. Flanging can be produced in a manner known per se by hot pressing, ultrasound or UV or IR irradiation.

A stepped accommodation area, which points upwards, is provided in the base block 19 and has a temperature-dependent switching mechanism located therein, with this switching mechanism, depending on its temperature, producing an electrically conductive connection between the cover part 12 and the bottom part 14, and therefore between the first and the second external connection 17 and 18, respectively.

Accommodation area 25 has three subareas 26, 27 and 28 which are located alongside one another. While subareas 26 and 27 are closed at the bottom, subarea 28 is in the form of a through-hole.

Subarea 27 is approximately square and is used to hold a bimetallic disc 29, which is likewise square and is inserted loosely into subarea 27.

As can also be seen from FIG. 1, a fixed opposing contact 31 is arranged on bottom part 14 and is located at the bottom in subarea 28. Fixed opposing contact 31 interacts with a moving contact part 32 which is arranged on a spring part 33, which will now be explained with reference to the exploded illustration of the switch shown in a view from underneath in FIG. 10.

Spring part 33 comprises a frame 34 which is integrally connected to a spring tongue 35, which is bent downwards, is fitted at its free end 36 with the moving contact part 32 and merges at its fixed end 37 into a transverse metal sheet 38, which is an integral part of frame 34.

At transverse metal sheet 38, the spring part 38 is connected by spot-welding to the flat metal part 15 of the cover part 12, as is indicated by weld points 39. Otherwise, the frame 34 rests flat on the metal part 15. When cover part 12 is placed on upper shoulder 21 which can be seen in FIG. 1, frame 34 is in this case located between shoulder 21 and cover part 12 and is clamped in between them when edge 24 is flanged over. This ensures a fixed flat connection between spring part 33 and metal part 15 in which case, because of the firm inseparable connection between metal part 15 and spring part 33, these are placed as a unit onto base block 19, thus considerably simplifying the assembly process.

A spherical cup 41 which points downwards can also be seen on spring tongue 35 in FIG. 2, with bimetallic disc 29 acting on this spherical cup 41 when it lifts the moving contact part 32 off the fixed opposing contact 31, as will be explained in the following text in conjunction with FIGS. 3 and 4.

Figure 2:
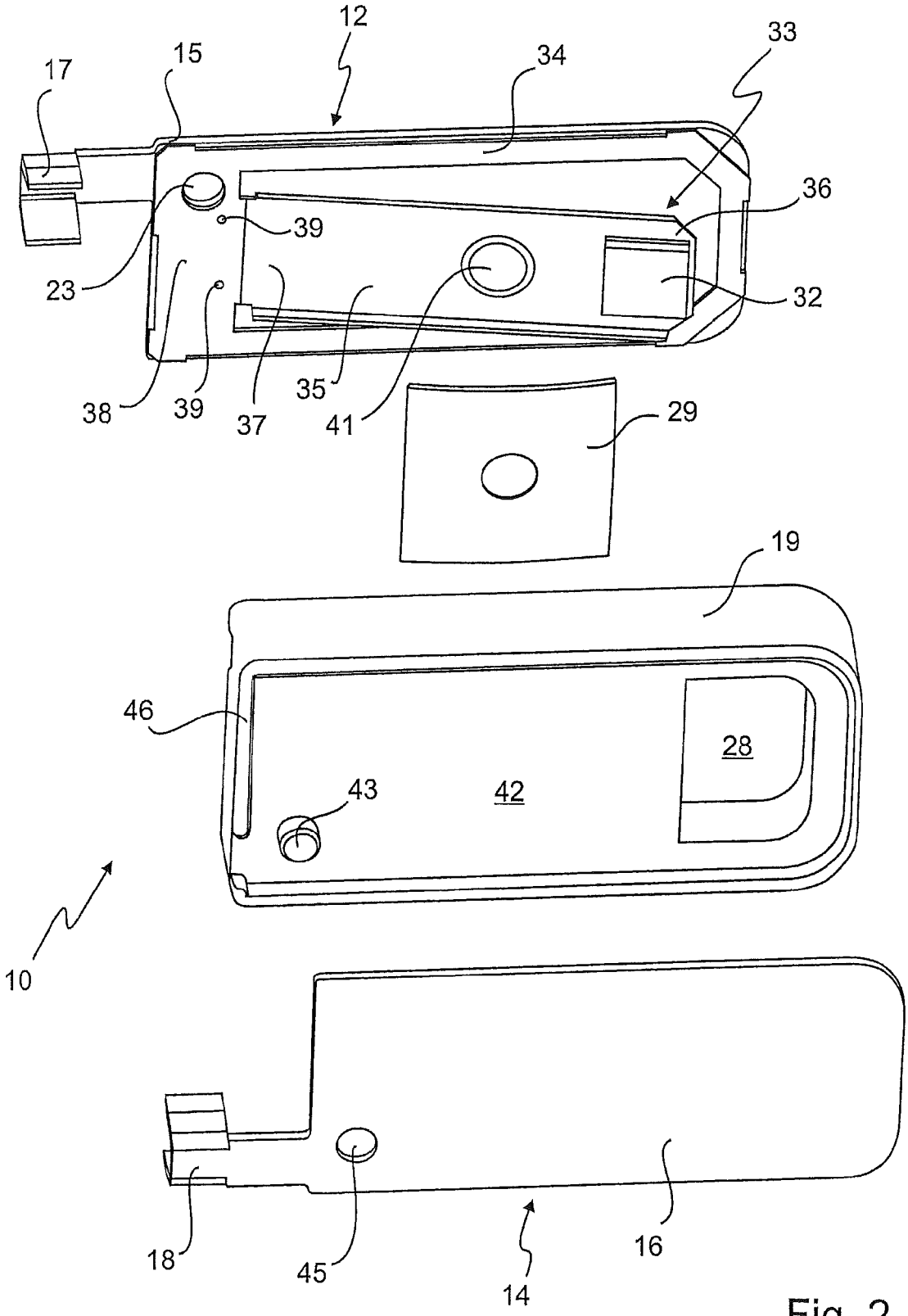
FIG. 2 shows an exploded illustration of the switch from FIG. 1, in the form of a schematic view from underneath.

FIG. 2 also shows that base block 19 has a flat contact surface 42 on its lower side, on which lower side the metal part 16 of the bottom part 14 is located. A pin 43 is provided on the contact surface 42 for alignment and passes through a through-hole 45, which is provided in the bottom part 14, when this bottom part 14 is fitted.

Base block 19 also has a circumferential edge 46 on its lower side, which has an aperture for the external connection 18 in the area of pin 43.

Edge 46 is flanged over for attachment of the bottom part 14 to the base block 19, in precisely the same way as has already been described for the circumferential edge 24 in conjunction with FIG. 1.

Figure 3:
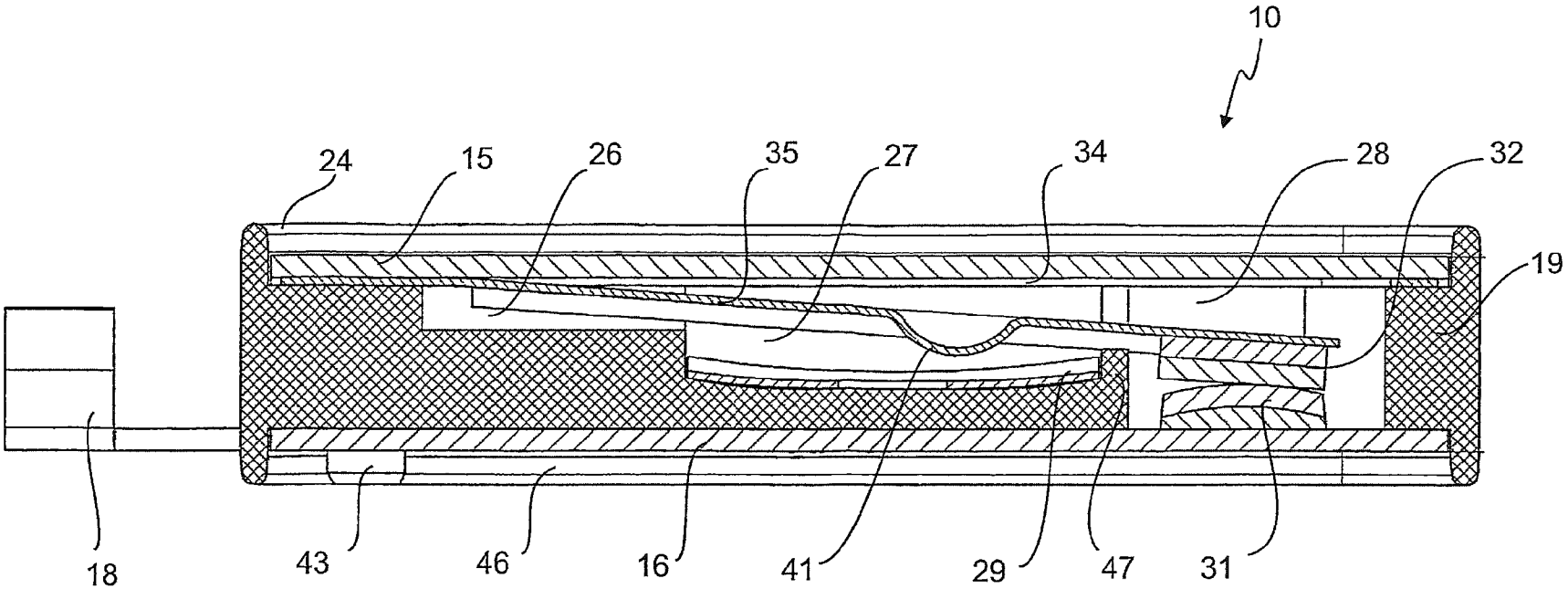
FIG. 3 shows an illustration of the assembled switch from FIG. 1, in the form of a side section illustration, with the pair of switching contacts being closed.

FIG. 3 shows a longitudinal section through the switch 10 from FIGS. 1 and 2, in the assembled state. Like FIGS. 1 and 2, the illustration in FIG. 3 is also only schematic, and should not be considered to be true to scale.

As can be seen in FIG. 3, fixed end 37 of spring tongue 35 is located in subarea 26, and extends from there obliquely downwards into subarea 27, where bimetallic disc 29 is located opposite spherical cup 41.

Spring tongue 35 extends further into subarea 28, where its moving contact part 32 makes contact with fixed opposing contact 31.

The switching state shown in FIG. 3 is the closed state of switch 10, in which state bimetallic disc 29 is below its response temperature.

As can be seen from FIG. 3, subareas 27 and 28 are separated from one another by a web 47, which can also be seen in FIG. 1. This web is at the same time also used for side fixing of bimetallic disc 29 in subarea 27.

Figure 4:
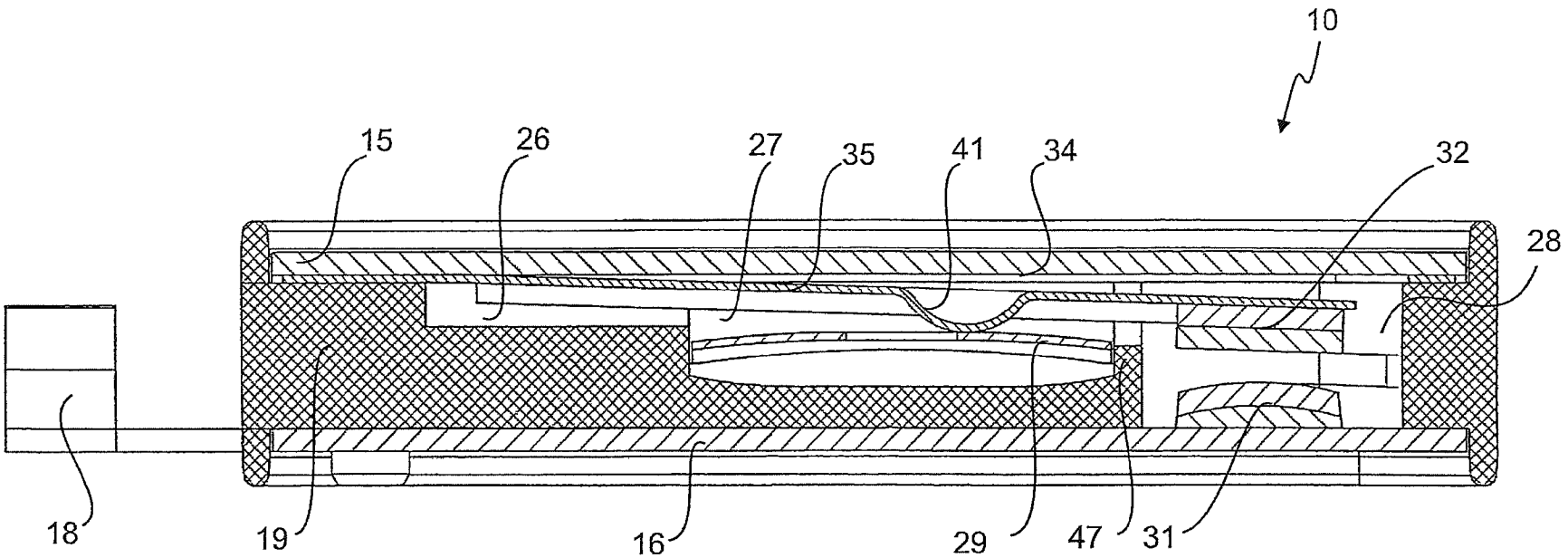
FIG. 4 shows an illustration as in FIG. 3, but with the pair of switching contacts open.

If the temperature of the switch 10 and therefore the temperature of the bimetallic disc 29 is now raised beyond the response temperature, bimetallic disc 29 snaps from its slightly concave shape, as shown in FIG. 3, to a convex shape, as is illustrated in FIG. 4.

Because of the arching curvature of bimetallic disc 29, it makes contact with spherical cup 41 and, via this, presses spring tongue 35 in FIG. 4 upwards, as a result of which moving contact part 32 is disengaged from fixed opposing contact 31. Because of the chosen design, in particular because of spherical cup 41, moving contact part 32 is in this case lifted off the fixed opposing contact 31 through a large switching movement, as a result of which this pair of switching contacts are now a long distance apart from one another, thus allowing high voltages, high currents and high powers to be switched. The chosen design comprising a base block 19 and metal parts 15 and 16 attached thereto also contributes to this, because the switching movement of the pair of switching contacts 31, 32 is thus of a maximum size for the given dimensions.

The switching of high currents is further made possible since spring part 33 has a relatively large area because of frame 34 and spring tongue 35, with a very low contact resistance being ensured because of the flat contact between metal part 15 and frame 34 as well as the welding at least at points.

In the novel switch 10, the switching of high currents is also made possible by the pair of switching contacts 31, 32 being arranged in a separate subarea, which is separated from subarea 27 in which bimetallic disc 29 is located. This means that sudden arcs which occur possibly with resultant sparking, cannot damage the bimetallic disc 29.

Figure 5:
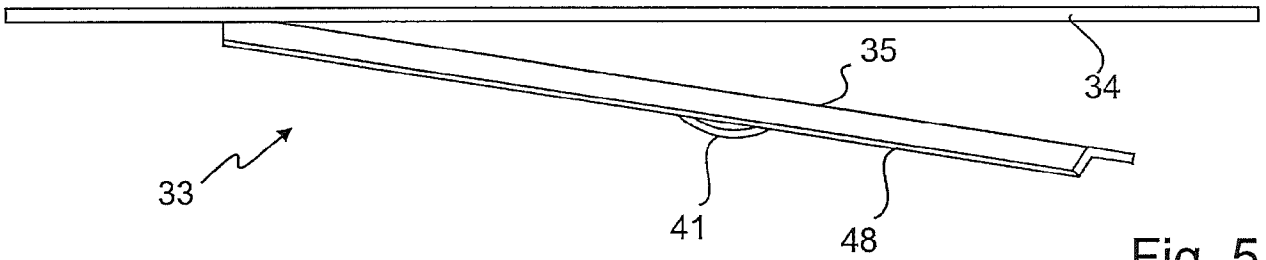
FIG. 5 shows a schematic side view of the spring part from FIG. 2.
Figure 6:
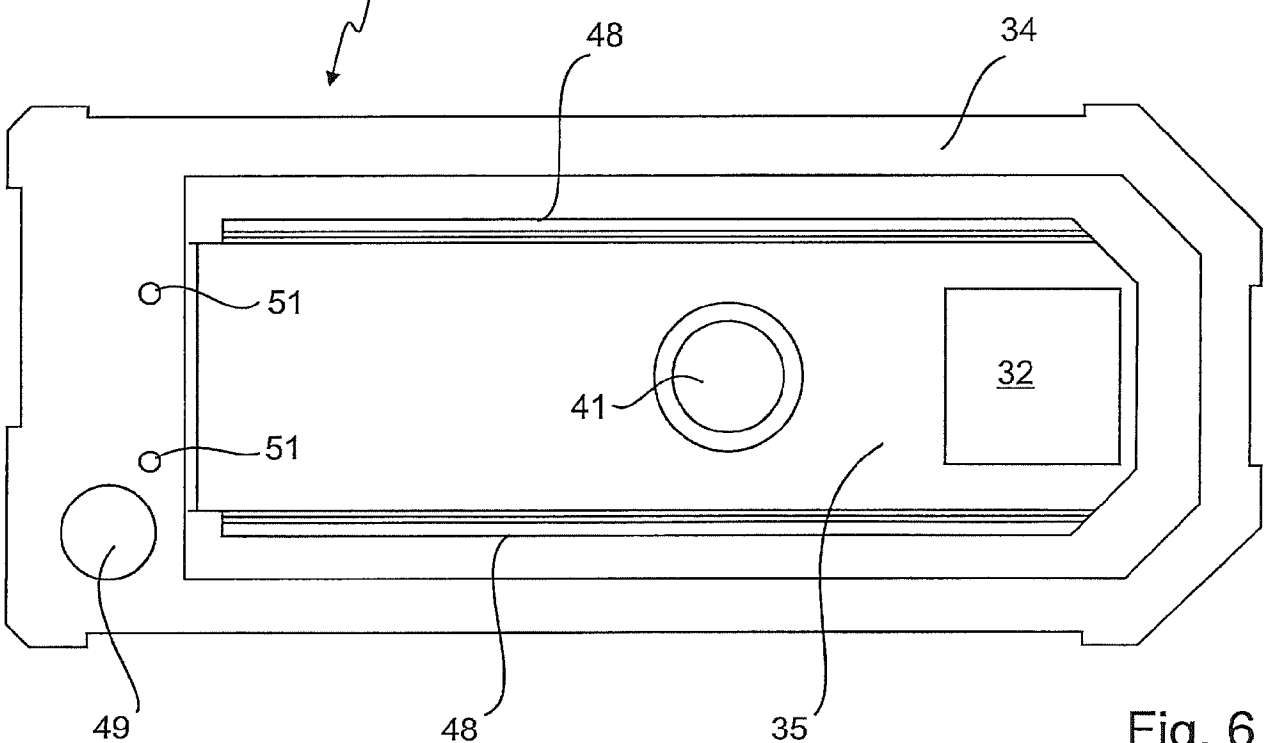
FIG. 6 shows a plan view of the spring part from FIG. 5, from underneath.

FIGS. 5 and 6 show spring part 33 in a schematic side view and in a view from underneath, respectively.

Like metal parts 15 and 16, spring part 33 is also a stamped part, which is produced as one-piece part.

As can be seen from the side view in FIG. 5, spring tongue 35 has edges 48 which are curved downwards at the side, and which make spring tongue 35 more robust.

As can also be seen from FIG. 6, a through-hole 49 for pin 22 as well as a through-hole 51 for weld points 39 are provided in frame 34.

Because of the chosen design, the novel switch 10 can be assembled very easily, and the individual parts can also be produced without any problems and at low cost.

Metal parts 15 and 16 as well as spring part 33 are stamped parts which are to be stamped out and possibly subsequently bent. After this, the fixed opposing contact 31 is welded to the metal part 16, while the moving contact part 32 is welded to the spring tongue 35.

Spring part 33 is then welded from underneath to the flat metal part 15 which forms the cover part 12, with only two spot welds 39 being required for this purpose.

Bimetallic disc 29 is then inserted into accommodation area 25, after which cover part 12 is placed on the upper circumferential shoulder 21 and is attached by flanging over edge 24. In consequence, spring tongue 35 enters subareas 26, 27 and 28.

Before or after this, bottom part 14 is also placed on base block 19 from underneath and is attached there by flanging over edge 46. During this process, the fixed opposing contact 31 enters subarea 28.

The novel switch 10 is now ready for operation, spring tongue 35 presses moving contact part 32 onto fixed opposing contact 31 and thus ensures that there is an electrically conductive connection between the two external connections 17 and 18.

Base block 19 isolates the metal parts 15 and 16 from one another, provided that it is manufactured from insulating material. If base block 19 is produced from PTC material, it acts as a self-holding resistance, which is connected in parallel with the switching mechanism between the external connections 17, 18.

Figure 7:
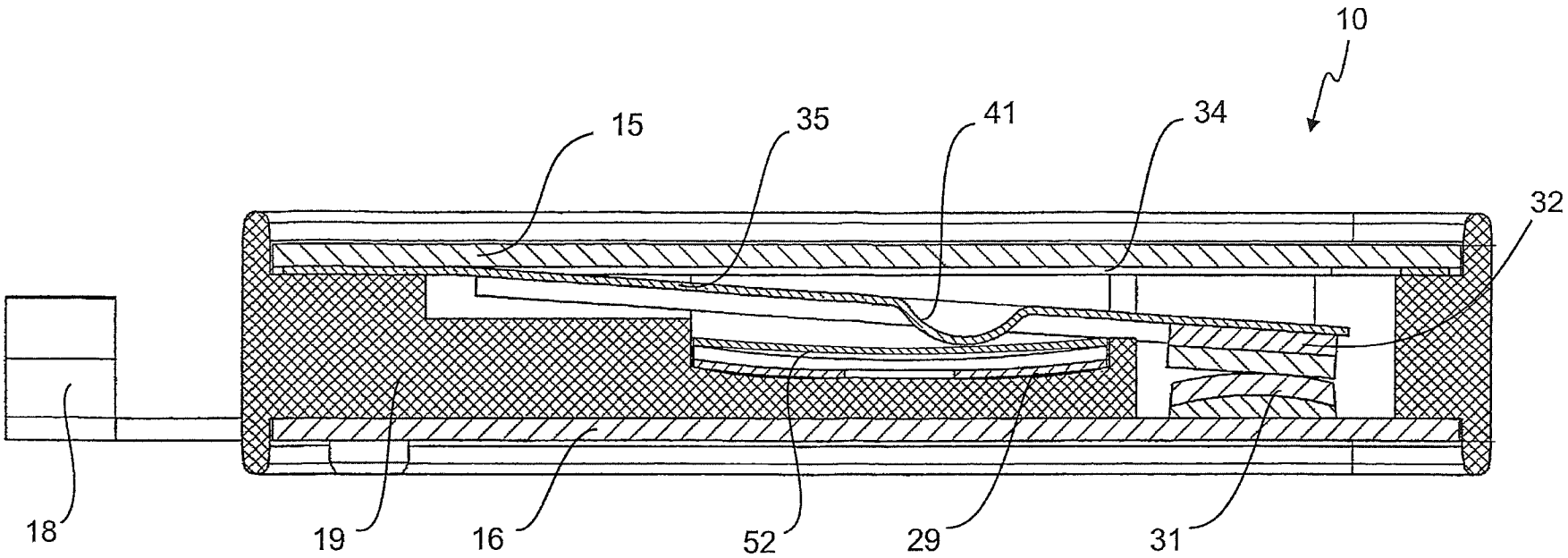
FIG. 7 shows an illustration of the switch as in FIG. 3, but with an additional ceramic disc for protection of the bimetallic disc.

If the intention is to use the novel switch 10 to switch even higher currents than, for example 10 amperes, a ceramic disc 52 can also be arranged in subarea 27, in order to protect bimetallic disc 29, which ceramic disk is located between bimetallic disc 29 and spherical cup 41 or spring tongue 35, as is shown in FIG. 7.

Ceramic disc 52 protects bimetallic disc 29 against arcs and sparking even more efficiently than is already the case with the design shown in FIGS. 1 to 4, as a result of which even higher currents can be switched, without there being any risk of damage or premature ageing of bimetallic disc 29.

Therefore, what is claimed is:

1. A temperature-dependent switch, comprising:

a base block having an open upper side and an open lower side, an accommodation area extending between said upper and lower side, an electrically conductive cover metal plate arranged on and closing off said upper side, said cover plate being provided with a first external connection, an electrically conductive bottom metal plate arranged on and closing off said lower side, said bottom plate being provided with a second external connection, a temperature-dependent switching mechanism which is arranged in the accommodation areas and makes an electrically conductive connection between the first and the second external connection, as a function of its temperature, the switching mechanism comprising a spring tongue which is integrally connected at its first end to a transverse electrically conductive metal sheet, which in turn is connected to the cover plate, the transverse metal sheet being formed as a one-piece part with an electrically conductive frame which rests flat on the cover plate and which is firmly connected thereto in a captive manner by a method selected from adhesive bonding, soldering and welding, said spring tongue being fitted at its second end with a moving contact part which interacts with a fixed counter contact provided at the bottom plate, and a bimetallic part arranged next to the spring tongue within the accommodation area, which bimetallic part is arranged such that it acts on an operating section of the spring tongue, which operating section is located between the first end and the second end of the spring tongue, such that the bimetallic part, as a function of its temperature, lifts off the moving contact part from the fixed counter contact.

2. A temperature-dependent switch, comprising:

a housing having an upper side and carrying a first and a second external connection, an electrically conductive cover part arranged on the upper side and closing the housing, said cover part being directly connected to the first external connection, a temperature-dependent switching mechanism which is arranged in the housing and makes an electrically conductive connection between the first and the second external connection, as a function of its temperature, the switching mechanism comprising:

a spring part having a first end and a second end, which spring part is electrically connected at its first end to one of the first and second external connections, and which spring part is fitted at its second end with a moving contact part which interacts with the other of the first and second external connections, and a bimetallic part, which electrically disconnects the moving contact part from the other of the first and second external connections as a function of its temperature, the spring part being firmly connected at its first end to the cover part in a captive manner by a method selected from adhesive bonding, soldering and welding, wherein the bimetallic part is arranged loosely next to the moving contact part in an accommodation area, which accommodation area is open to the cover part in the housing, wherein a through-hole, in which the moving contact part is arranged, is provided in the housing, and wherein a web is provided between the accommodation area and the through-hole, which web fixes the bimetallic part at the side and screens it from the moving contact part.

3. A temperature-dependent switch, comprising:

a housing having an upper side and carrying a first and a second external connection, an electrically conductive cover part arranged on the upper side and closing the housing, said cover part being directly connected to the first external connection, a temperature-dependent switching mechanism which is arranged in the housing and makes an electrically conductive connection between the first and the second external connection, as a function of its temperature, the switching mechanism comprising:

a spring part having a first end and a second end, which spring part is electrically connected at its first end to one of the first and second external connections, and which spring part is fitted at its second end with a moving contact part which interacts with the other of the first and second external connections, and a bimetallic part, which electrically disconnects the moving contact part from the other of the first and second external connections as a function of its temperature, the spring part being firmly connected at its first end to the cover part in a captive manner by a method selected from adhesive bonding, soldering and welding, wherein a bottom part is provided, which closes the housing on its lower side and on which the second external connection is provided, wherein the bottom part is electrically conductive and directly connected to the second external connection;

wherein the spring part comprises a spring tongue which is integrally connected at its first end to a transverse electrically conductive metal sheet, which in turn is connected to the cover part, and wherein the transverse metal sheet is formed as one-piece part with an electrically conductive frame which rests flat on the cover part and which is firmly connected thereto.

4. The switch of claim 3, wherein a circumferential shoulder is formed on the housing, on which shoulder the cover part rests with the interposition of the frame.

5. The switch of claim 3, wherein the spring tongue is fitted at its second, free end with the moving contact part, and wherein a fixed opposing contact is arranged on the bottom part.

6. The switch of claim 3, wherein the bimetallic part is arranged loosely next to the moving contact part in an accommodation area, which accommodation area is open to the cover part in the housing.

7. The switch of claim 3, wherein the bimetallic part acts on an operating section of the spring tongue, which operating section is located between the first end and a second end of the spring tongue.

8. The switch of claim 7, wherein the operating section of the spring tongue comprises a spherical cup which points towards the bimetallic part.

9. The switch of claim 3, wherein the housing is at least partially manufactured from insulation material, preferably from thermally conductive plastic or ceramic.

10. A temperature-dependent switch, comprising:

a housing having an upper side and carrying a first and a second external connection, an electrically conductive cover part arranged on the upper side and closing the housing, said cover part being directly connected to the first external connection, a temperature-dependent switching mechanism which is arranged in the housing and makes an electrically conductive connection between the first and the second external connection, as a function of its temperature, the switching mechanism comprising:

a spring part having a first end and a second end, which spring part is electrically connected at its first end to one of the first and second external connections, and which spring part is fitted at its second end with a moving contact part which interacts with the other of the first and second external connections, and a bimetallic part, which electrically disconnects the moving contact part from the other of the first and second external connections as a function of its temperature, the spring part being firmly connected at its first end to the cover part in a captive manner by a method selected from adhesive bonding, soldering and welding, wherein a bottom part is provided, which closes the housing on its lower side and on which the second external connection is provided, wherein the bottom part is electrically conductive and directly connected to the second external connection, wherein the housing comprises a solid base block in which at least one accommodation area for the temperature-dependent switching mechanism is provided, wherein the base block is closed by the bottom part, which is in the form of a first flat metal part, and by the cover part, which is in the form of a second flat metal part, and wherein the bimetallic part is arranged loosely next to the moving contact part in an accommodation area, which accommodation area is open to the cover part in the housing, wherein a through-hole, which extends from the first to the second flat metal part, is provided in the base block, into which through-hole an integral spring tongue with the moving contact part extends laterally, wherein a fixed opposing contact is arranged in the through-hole on the second metal part, and wherein a web is provided between the accommodation area and the through-hole.

11. The switch of claim 10, which consists solely of the base block, the first and the second flat metal parts, the spring part which is firmly connected to the first metal part and is comprised of an electrically conductive frame and the integral spring tongue, the fixed opposing contact arranged on the bottom part, the moving contact part and the bimetallic part.

12. A temperature-dependent switch, comprising:

a housing having an upper side and carrying a first and a second external connection, an electrically conductive cover part arranged on the upper side and closing the housing, said cover part being directly connected to the first external connection, a temperature-dependent switching mechanism which is arranged in the housing and makes an electrically conductive connection between the first and the second external connection, as a function of its temperature, the switching mechanism comprising:

a spring part having a first end and a second end, which spring part is electrically connected at its first end to one of the first and second external connections, and which spring part is fitted at its second end with a moving contact part which interacts with the other of the first and second external connections, and a bimetallic part, which electrically disconnects the moving contact part from the other of the first and second external connections as a function of its temperature, the spring part being firmly connected at its first end to the cover part in a captive manner by a method selected from adhesive bonding, soldering and welding, wherein a ceramic disc is provided geometrically between the bimetallic part and the spring part.

13. The switch of claim 12, wherein a bottom part is provided, which closes the housing on its lower side and on which the second external connection is provided.

14. The switch of claim 13, wherein the bottom part is electrically conductive and directly connected to the second external connection.

15. The switch of claim 14 wherein the cover part, the bottom part and the spring part are stamped one-piece parts.

16. The switch of claim 14, wherein the housing comprises a solid base block in which at least one accommodation area for the temperature-dependent switching mechanism is provided, wherein the base block is closed by the bottom part, which is in the form of a first flat metal part, and by the cover part, which is in the form of a second flat metal part.

17. The switch of claim 16, wherein the cover part and the bottom part are fixed to the base block by means of flanged edges.

* * * * *